US006204485B1

(12) United States Patent
Williams

(10) Patent No.: US 6,204,485 B1
(45) Date of Patent: Mar. 20, 2001

(54) TOOTHPASTE WARMER

(76) Inventor: Frank J. Williams, 2941 Hudson St., Baltimore, MD (US) 21224

( * ) Notice: Subject to any disclaimer, the term of this patent is extended or adjusted under 35 U.S.C. 154(b) by 0 days.

(21) Appl. No.: 09/498,475

(22) Filed: Feb. 4, 2000

Related U.S. Application Data

(60) Provisional application No. 60/129,034, filed on Apr. 13, 1999.

(51) Int. Cl.[7] ..... B67D 5/63; A47K 5/00

(52) U.S. Cl. ..... 219/429; 219/432; 219/433; 222/146.5

(58) Field of Search ..... 219/429, 432, 219/433, 436, 214; 222/146.5; 239/135

(56) References Cited

U.S. PATENT DOCUMENTS

| | | | | |
|---|---|---|---|---|
| 1,414,494 | * | 5/1922 | Arntfield | 219/433 |
| 2,079,611 | | 5/1937 | Harvey . | |
| 2,277,605 | * | 3/1942 | Palitzsch | 219/436 |
| 2,500,241 | * | 3/1950 | Brown | 219/521 |
| 2,516,637 | * | 7/1950 | McCollum | 219/433 |
| 2,526,447 | * | 10/1950 | Aiken | 219/433 |
| 2,955,191 | | 10/1960 | Galgano et al. . | |
| 3,231,716 | * | 1/1966 | van den Bosch | 219/433 |
| 3,432,641 | * | 3/1969 | Welke | 219/433 |
| 3,804,076 | * | 4/1974 | Fant et al. | 219/432 |
| 4,421,973 | | 12/1983 | Lou . | |
| 4,716,278 | * | 12/1987 | Cappe et al. | 219/521 |
| 4,926,029 | | 5/1990 | Pearson . | |
| 4,943,705 | | 7/1990 | Halloran . | |
| 5,210,396 | | 5/1993 | Sanders . | |
| 5,436,429 | * | 7/1995 | Cline | 219/202 |
| 5,700,991 | | 12/1997 | Osbern . | |
| 5,786,573 | | 7/1998 | Fabrikant et al. . | |

FOREIGN PATENT DOCUMENTS

| | | |
|---|---|---|
| 394191 | 6/1932 | (GB) . |
| 1264168 | 2/1972 | (GB) . |

* cited by examiner

*Primary Examiner*—Joseph Pelham
(74) *Attorney, Agent, or Firm*—Richard C. Litman

(57) ABSTRACT

A warmer for heating a toothpaste container. The container may be either a toothpaste tube or a pump. The warmer has a toothpaste compartment with a central cavity to hold the toothpaste container. The toothpaste compartment is attached to a base which is preferably weighted to prevent tipping. An electrical heating element may be located entirely in the base or may partially surround the central cavity. The heating element may be controlled by a timer so that the toothpaste is heated at preset times. A toothbrush compartment may be attached to the toothpaste compartment for heating a toothbrush. The warm toothpaste makes tooth brushing more comfortable and pleasant for persons whose teeth are sensitive to the cold.

19 Claims, 5 Drawing Sheets

TOOTHPASTE WARMER

CROSS-REFERENCE TO RELATED APPLICATION

This application claims the benefit of U.S. Provisional Patent Application Ser. No. 60/129,034, filed Apr. 13, 1999.

BACKGROUND OF THE INVENTION

1. Field of the Invention

The present invention relates generally to medical devices. More specifically, the invention concerns dental products.

2. Description of Related Art

According to the American Dental Association one out of every four persons in the U.S. alone has teeth which are sensitive to the cold. For these millions of people, any drinking of cold liquids or eating cold foods can be uncomfortable or even painful. An often-overlooked component of this problem is its effect on tooth brushing. Brushing with cold toothpaste on a cold toothbrush can be very unpleasant for a person with cold-sensitive teeth. Though such a person is often well aware of the importance of good dental hygiene, when brushing is painful there is a natural tendency to avoid brushing or to "forget" to brush. This leads to less frequent brushing. The teeth may also be brushed less thoroughly. The consequences are increased rates of dental problems, frequent trips to the dentist, and higher expenses for dental care. Children often have cold-sensitive teeth; avoiding brushing may be the only clue parents have of the problem.

Some people with cold-sensitive teeth warm a toothbrush by running hot water over it before brushing. This can take time, particularly in a home where hot water is not immediately available. Running water to warm it also wastes water. Even if the toothbrush is warm from the hot water, the toothpaste remains cold, so brushing can still be unpleasant. Toothpaste takes time to equilibrate to room temperature; if a home is kept cool at night, the toothpaste may still be very cold when the teeth are brushed in the morning.

Toothpaste formulated for sensitive teeth can help with the problem of cold sensitivity, but is not a complete solution. Brushing with this toothpaste can still be uncomfortable when the toothpaste is very cold. Specially formulated toothpaste is also expensive. The number of formulations available is very limited, so that the toothpaste may not have other features desired by the user.

U.S. Pat. No. 4,421,973 to Lou discloses an apparatus for prewarming tooth paste in a tooth paste tube. A cap-shaped member replaces the original cap of the tooth paste tube. The cap-shaped member has an electrical heating element enveloping the outlet end of the tooth paste tube. The tooth paste passes through the apparatus. A thermostat in the cap-shaped member controls the temperature. The cap-shaped member has a stiff area which is formed into a rigid electrical plug, so that it can be inserted directly into an electric wall socket.

U.S. Pat. 2,955,191 to J. A. Galgano et al. discloses a heating device for aerosol-type lather dispensers. The device provides hot lather for shaving. The device has a slot to permit it to be wall-mounted on a support screw or bolt.

U.S. Pat. 5,210,396 to Sanders discloses an electrical baby wipe warmer apparatus. The container body surrounds and heats all sides of a baby wipe box. A container lid member is pivotally connected to the container body.

U.S. Pat. 5,700,991 to Osbern discloses a device for heating a gel for use in physical examinations. The warm gel alleviates patient discomfort during pelvic, rectal, and genital examinations and the like. A plastic heat exchanger surrounds the gel container. A base having a larger diameter than the heat exchanger prevents tipping. A thermostated heating coil in the base heats a heat exchange fluid, such as vegetable oil.

U.S. Pat. 5,786,573 to Fabrikant et al. discloses a heater for shaving cream having a ring-shaped heating element. The heating element may be donut-shaped to fit around the shaving cream container. An inner ring may be included to allow the heating element to be slidably adjusted up and down the length of the container. Alternatively, the heating element may be dome-shaped to fit into the bottom of a shaving cream container.

British Patent No. 394,191 to Ottosson discloses an apparatus for boiling liquids for medicinal and chemical purposes. The apparatus has a receiving chamber for a test tube surrounded by aggregate. A heating element is mounted in the aggregate at an angle of about 45°. Alternatively, the heating element may be mounted in a tubular container which is adjustable to various angular positions.

None of the above inventions and patents, taken either singly or in combination, is seen to describe the instant invention as claimed.

SUMMARY OF THE INVENTION

The present invention is a warmer for heating a toothpaste container. The container may be either a toothpaste tube or a pump. The warmer has a toothpaste compartment with a central cavity to hold the toothpaste container. The toothpaste compartment is attached to a base which is preferably weighted to prevent tipping. An electrical heating element may be located entirely in the base or may partially surround the central cavity. The heating element may be controlled by a timer so that the toothpaste is heated at preset times. A toothbrush compartment may be attached to the toothpaste compartment for heating a toothbrush. The warm toothpaste makes tooth brushing more comfortable and pleasant for persons whose teeth are sensitive to the cold.

Accordingly, it is a principal object of the invention to provide a toothpaste warmer having a toothpaste compartment with a central cavity to hold a toothpaste container, a weighted base, and a heating element.

It is another object of the invention to provide a toothpaste warmer which makes tooth brushing comfortable and pleasant for persons whose teeth are sensitive to the cold.

It is a further object of the invention to provide a toothpaste warmer which includes a toothbrush compartment for heating a toothbrush.

Still another object of the invention is to provide a toothpaste warmer having a timer which controls the heating element, so that warm toothpaste is available at preset times.

Another object of the invention is to provide a toothpaste warmer which is safe and easy to use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
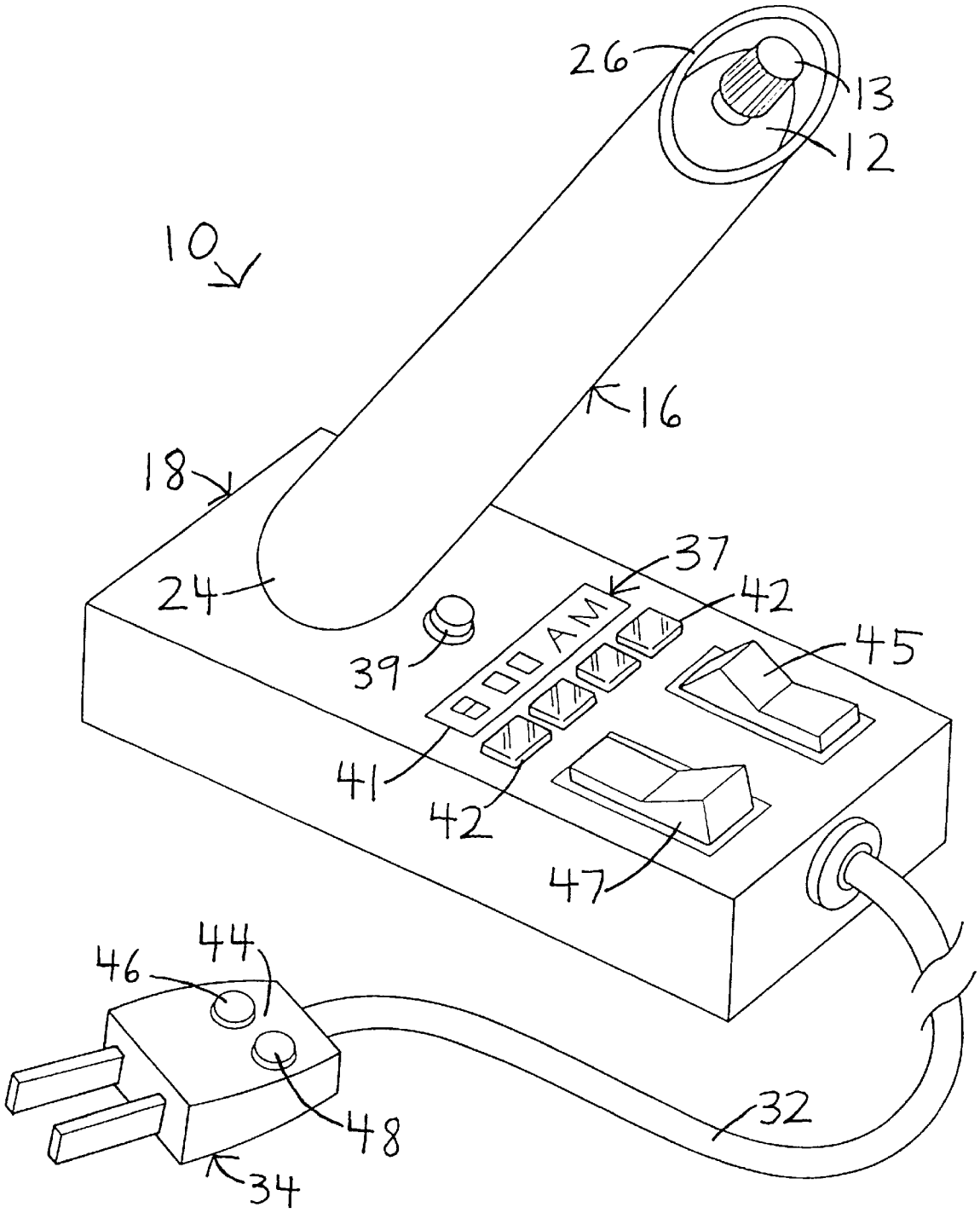
FIG. 1 is a perspective view of a toothpaste warmer according to the present invention.

The present invention is a warmer 10 for heating a toothpaste container. The toothpaste container may be a toothpaste tube 12 or a toothpaste pump 14. Each toothpaste container has a cap end 13 and an opposite sealed end 15. The toothpaste warmer 10 includes a toothpaste compartment 16, a base 18, and a heating element 20.

The toothpaste compartment 16 has a central cavity 22 which is adapted to hold the toothpaste container 12 or 14. See FIGS. 2, 4, 5, and 7. The toothpaste compartment 16 has a bottom end 24 and an outlet end 26. Preferably the central cavity extends at least two-thirds of the length of the toothpaste container.

In a preferred embodiment, the cap end 13 of the toothpaste container is proximate to the outlet end 26 of the toothpaste compartment,. The sealed end 15 is then proximate to the bottom end 24 of the toothpaste compartment. However, if desired a top-down configuration may be used, with the cap end 13 proximate to the bottom end 24.

The toothpaste compartment 16 has an outer shell 17 and an inner shell 19. The two shells may be composed of the same or different materials. The outer shell 17 forms the exterior of the toothpaste compartment. The inner shell 19 surrounds the central cavity 22, adjacent to the toothpaste container. The inner shell is preferably shaped to fit the toothpaste container. A close fit between the inner shell and the toothpaste container may be desirable to minimize heat losses, especially if the outlet end 26 of the toothpaste compartment is open. However, a close fit is not essential. An inner shell which does not fit closely is more adaptable to various sizes and shapes of toothpaste containers.

Both shells of the toothpaste compartment 16 are preferably composed of metal or plastic. The inner shell of the toothpaste compartment 19 is optimally composed of a heat conductive material, such as metal or a heat conductive plastic. Aluminum is desirable for the inner shell for its light weight and ability to conduct heat. The aluminum may be teflon-coated to allow the toothpaste container to slip easily in and out. A teflon coating also makes cleaning the warmer easier. The inner shell 19 may have perforations 25 to increase heat transfer from the heating element 20 to the toothpaste container 12 or 14. See FIGS. 2, 6, and 7.

The inner shell may be flexible, so that it conforms to the shape of the toothpaste container. A flexible inner shell allows a single warmer to accommodate various sizes and shapes of toothpaste tubes. A flexible inner shell also allows toothpaste tubes to be inserted into the central cavity either cap end first or sealed end first, depending on the user's preferences.

A flexible inner shell may be composed of a flexible heat-conductive plastic. See FIG. 4. The plastic may be a synthetic foam 31, as in FIG. 3. The plastic may have the heating element adjacent to it or embedded within it, as in FIG. 4. Alternatively, the plastic may simply conduct heat from the base, as in FIG. 3. Heat conductors, such as metal strips, may be used to increase heat transfer from the base if desired.

Figure 5:
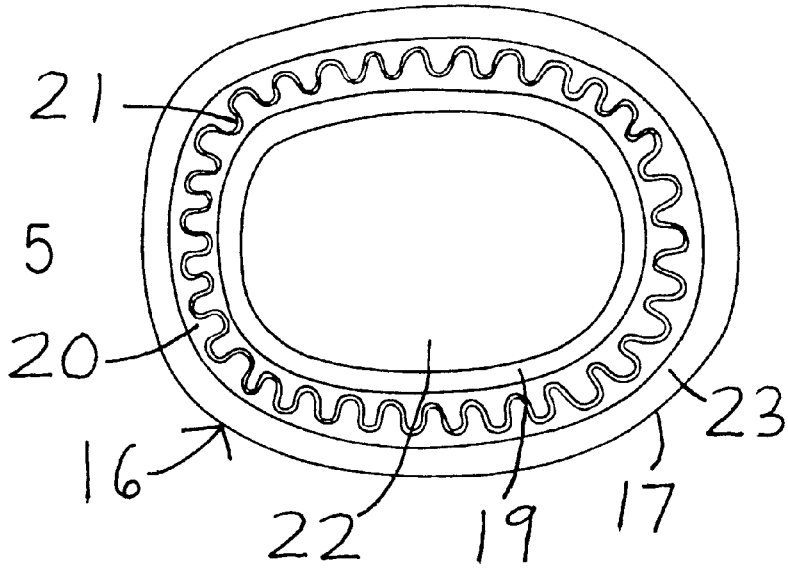
FIG. 5 is a cross-sectional view of a toothpaste warmer having an insulating layer, taken along line 5—5 of FIG. 4.

The outer shell 17 is preferably rigid. The outer shell 17 of the toothpaste compartment 16 may include a layer 23 of insulating material, as shown in FIG. 5. Insulation helps to prevent heat loss and keep the entire exterior cool and comfortable to the touch. However, the warmer is adapted to maintain a temperature only about 10–20° F. above typical room temperatures. This makes heat losses relatively small and burns unlikely, so that insulation is optional.

Ideally the outer shell 17 is tubular with a uniform or generally uniform cross-section, as shown in FIGS. 1–3 and 5–7. This gives a neat appearance and improves the stability of the warmer. For a toothpaste tube, an oval or flattened oval cross-section is preferable. See FIG. 5. Toothpaste pumps may have various shapes, such as an oval or circular cross-section. The outer shell 17 may therefore have a corresponding oval or circular cross-section. See FIG. 6.

Figure 4:
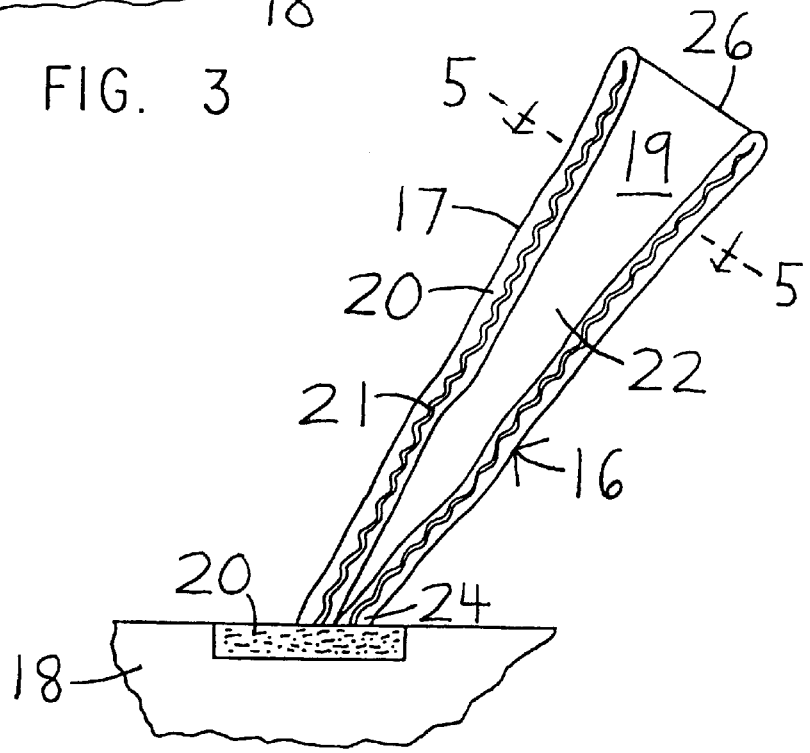
FIG. 4 is a fragmented, detail, side view of a toothpaste warmer having heating coils surrounding the central cavity.

The outer shell may be molded to the shape of a toothpaste tube, as in FIG. 4. This reduces the amount of material required for manufacturing and also the amount of material to be heated. However, this configuration can be more top-heavy and likely to tip. If both the outer and inner shells are flexible and molded to the shape of the toothpaste tube, the tube may be squeezed to expel toothpaste without removing the toothpaste tube from the warmer. See FIG. 4.

The toothpaste compartment is preferably large enough to accommodate the largest toothpaste tubes or pumps ordinarily sold. Suitable dimensions for the toothpaste compartment are about 3½–9 inches long and about 2–3 inches wide overall.

The toothpaste compartment 16 may have a container cap 27 pivotally attached to the outlet end 26 of the toothpaste compartment. The container cap 27 helps to limit heat from being lost through the outlet end 26 of the toothpaste compartment. Ideally the container cap 27 includes a hinge 29 so that the container cap pivots smoothly. A separate hinge 29 is desirable for durability, but a living hinge is also acceptable. A removable container cap is undesirable, because of the tendency for the cap to clutter a bathroom vanity, or to be lost entirely. The container cap may have a molded recess to receive the cap end of the toothpaste container. If the toothpaste compartment has a container cap, a close fit between the inner shell and the toothpaste container is less important.

The base 18 is attached to the bottom end 24 of the toothpaste compartment 16. The base supports the toothpaste compartment. The base and the toothpaste compartment are preferably fixedly attached. Alternatively, the base may be attached by screw threads or similar means and be removable to make the unit more compact for shipping.

The base is adapted to stabilize the toothpaste compartment and prevent the unit from tipping over when placed on a vanity or similar surface. The base 18 preferably has a weight at least equal to the weight of the toothpaste compartment 16 and the toothpaste container 12 or 14. A heavy base creates a low center of gravity and makes the warmer less likely to tip. Generally the heating element 20 and the other components of the base are sufficient to provide enough weight. If not, a weight member 28 may be placed in the base 18. See FIG. 2. The weight member may be composed of sand, metal, or any other dense material. Preferably the weight member is adjacent to the bottom 30 of the base 18, so that the warmer's center of gravity is as low as possible. Suitable dimensions for the base are about 4–6 inches long and about 3–4 inches wide.

The base 18 has a connecting means for connecting to an electrical source. This preferably includes a power cord 32 and a plug 34. The power cord 32 may extend from any surface of the warmer. Preferably the power cord extends from the rear of the warmer, so that the power cord is less likely to become entangled or to be pulled on.

The heating element 20 is attached to the base 18. Preferably the heating element is at least partially contained within the base. Any electrical heating element is suitable, such as a ceramic heating element, heating coils 21 of electrical resistance wire, and the like. Such heating elements are well known in the art. The heating element 20 receives electrical power from the connecting means, as shown in FIG. 2.

The heating element 20 is adapted to conduct heat to at least the bottom end 24 of the toothpaste compartment 16. The heating element 20 may be partially or completely embedded in the toothpaste compartment and surround the central cavity 22, as shown in FIGS. 4–7. For example, the heating element may be a blanket wrap with electrical coils sealed inside, and with one surface covered with an adhesive. The adhesive would attach the blanket wrap to the inner surface of an outer shell (such as an aluminum tube). Suitable blanket wraps are commercially available.

Figure 2:
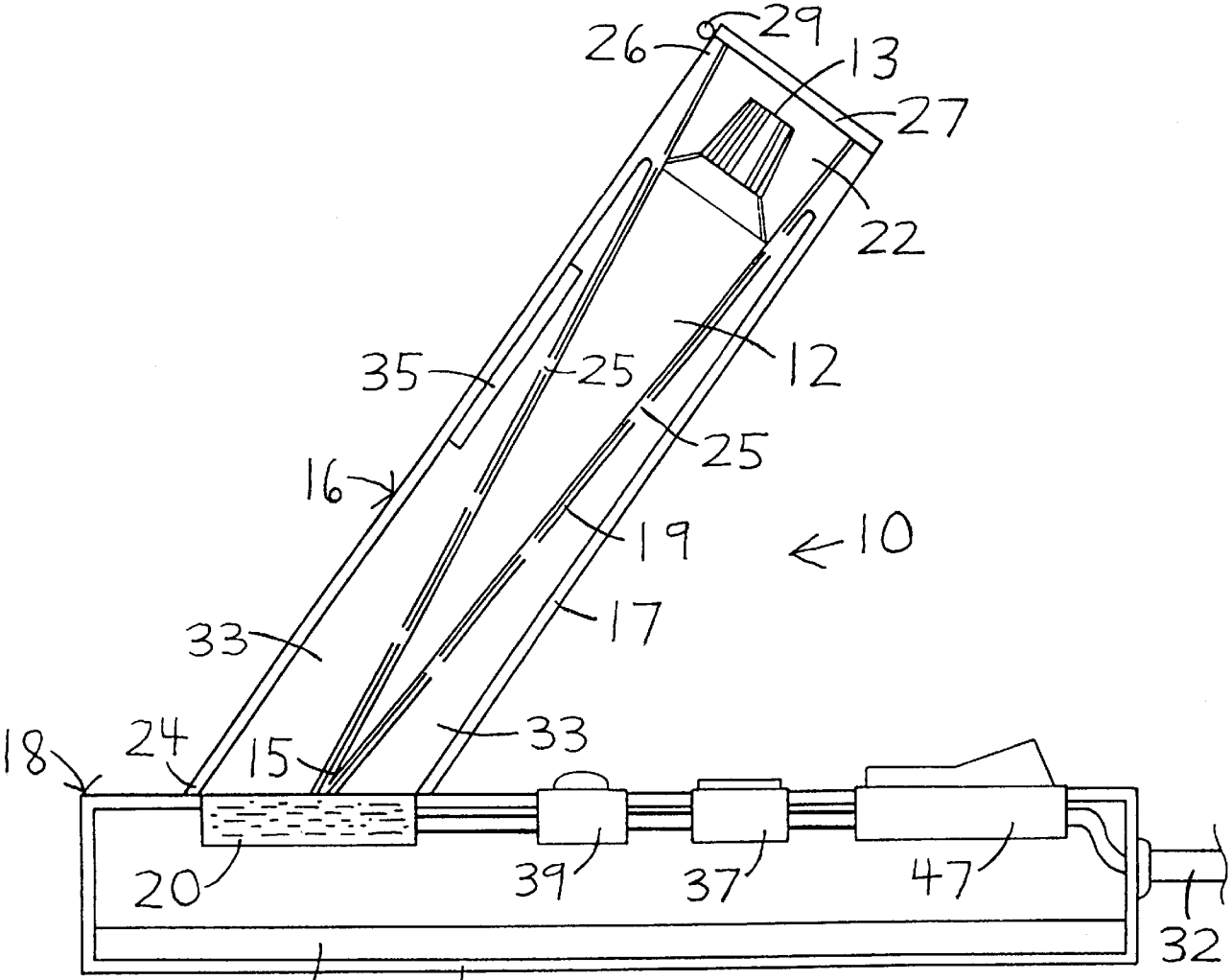
FIG. 2 is a fragmented, side view of a toothpaste warmer.
Figure 3:
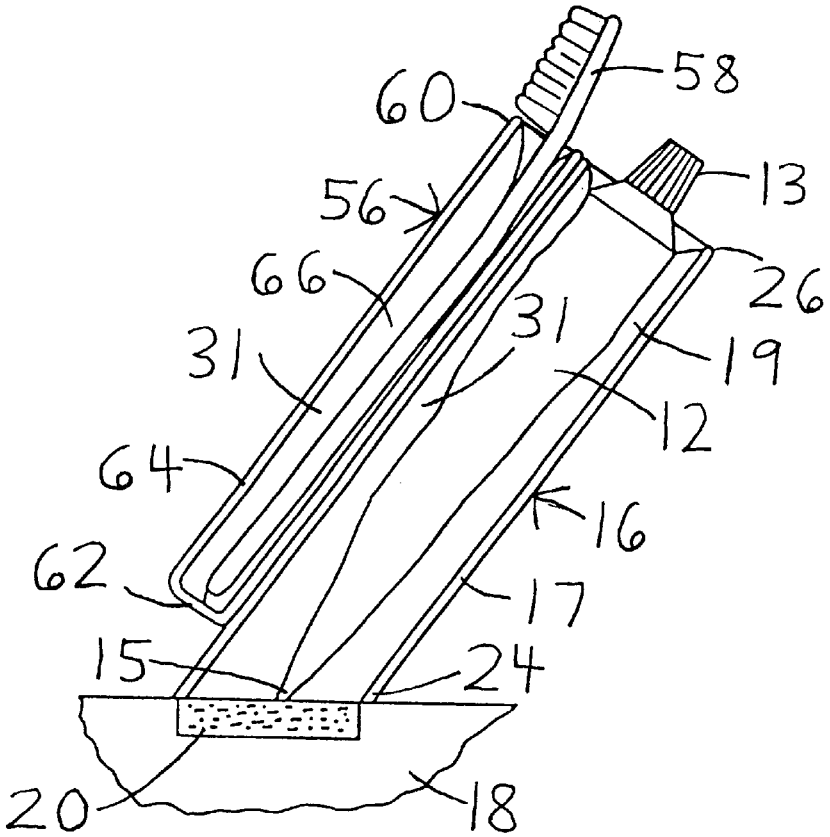
FIG. 3 is a fragmented, detail, side view of a toothpaste warmer having a toothbrush compartment.

The heating element 20 may be completely embedded in the base 18, as in FIGS. 2 and 3. In this arrangement the bottom end 24 of the toothpaste compartment contacts the heating element 20, so that heat is conducted to the inner shell and the toothpaste container. Having the heating element entirely in the base simplifies the device and lowers its center of gravity. However, if the toothpaste compartment does not conduct heat well, the toothpaste at the cap end 13 of the toothpaste container may not be adequately heated. The toothpaste dispensed from the cap end may not be warm. A heat-conductive inner shell of metal or the like may eliminate this problem; alternatively, the toothpaste container may simply be stored top down in the toothpaste compartment.

A heating element 20 embedded in the base 18 may heat an air space 33 between the inner and outer shell of the toothpaste compartments 19 and 17. See FIG. 2. The heated air rises to heat the entire inner shell and the toothpaste container. The heated air may circulate through the perforations 25 to heat the central cavity 22. If heated air is used, a container cap 27 is generally required to avoid excessive heat loss. The heated air space embodiment requires no flexible materials in the inner or outer shells and is inexpensive to manufacture.

Figure 7:
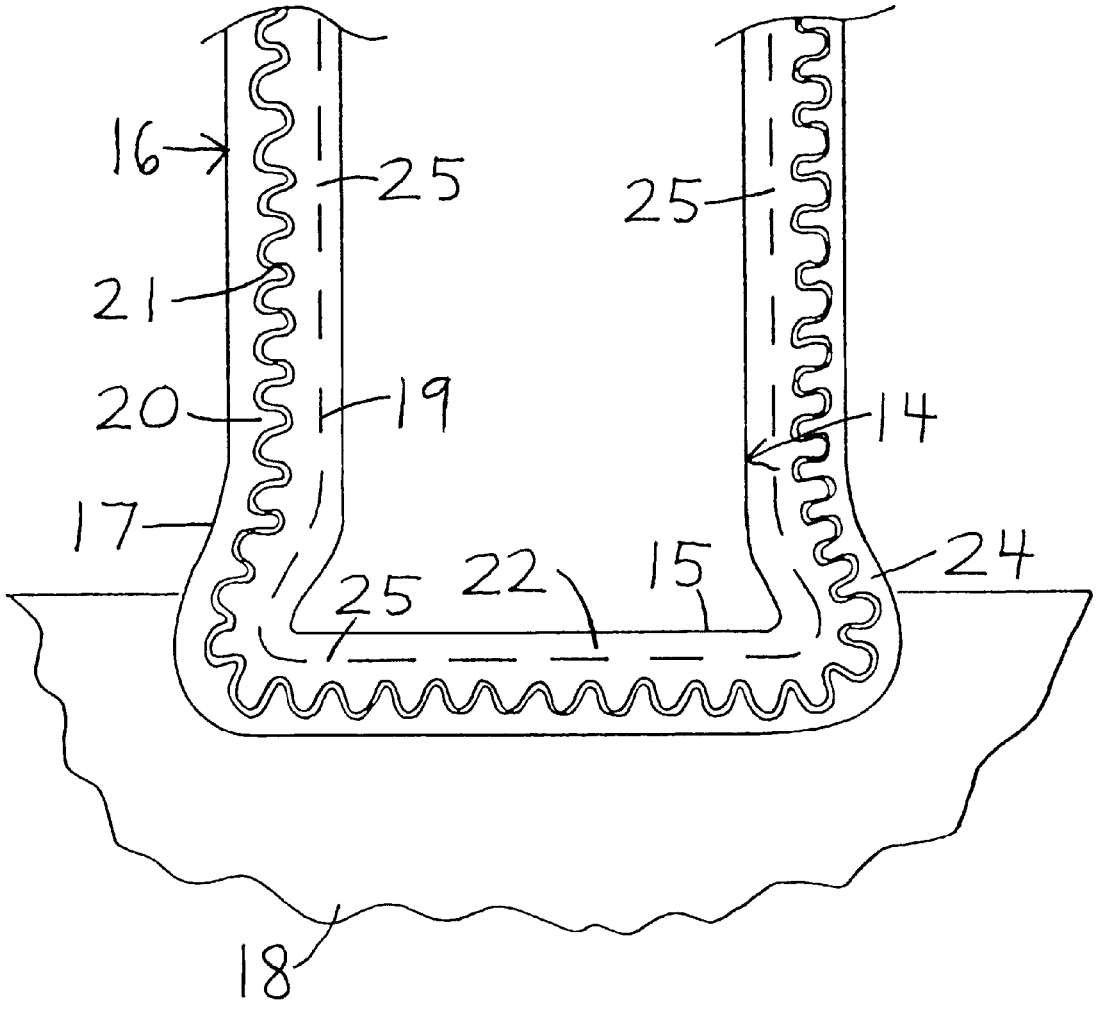
FIG. 7 is a fragmented, detail, side view of the toothpaste warmer of FIG. 6.

FIG. 4 shows part of the heating element embedded in the base, with part extending upward to surround the central cavity. The heating element 20 may be located between the outer and inner shells 17 and 19, as shown in FIGS. 4, 5, and 7.

The heating element 20 preferably maintains the toothpaste container at a temperature which is elevated above normal room temperature but less than body temperature. Temperatures above about 94° tend to make the toothpaste overly liquid, particularly with gel-type toothpastes. Temperatures above 100° F are known to degrade some toothpastes over time. Preferred temperatures range from about 80 degrees to about 90 degrees Fahrenheit.

The heating element 20 may include a thermostat 35 to maintain the temperature at the proper level. See FIG. 2. Suitable thermostats are commercially available. The thermostat 35 may be located in the base 18, the air space 33, the inner shell 19, or any other convenient location. A thermostat is more important if the heating element has a large heat output capable of rapidly heating the toothpaste to the desired temperature.

The warmer preferably includes a timer 37, as shown in FIGS. 1 and 2. The timer 37 controls the heating element 20 so that the toothpaste container is heated at preset times. Since the toothpaste spends less total time at an elevated temperature, the toothpaste can be warmed to higher temperatures with less risk of degradation. Preferably the timer has a display 41 and a set of control buttons 42 for time setting and other functions. Ideally the timer can be set for three or more on/off cycles per day and for variations in the user's daily schedule during a week. For example, the warmer might be set to turn on an hour before the user's normal waking time, turn off two hours later, on again before the user's return from work, and off again after bedtime. On weekend days, the warmer might turn on later and stay on all day. If desired, the timer can be set to maintain various temperature levels at various times, instead of a simple on/off cycle. Suitable timers are commercially available.

Other features also make the warmer more convenient and safer to use. The warmer 10 has a standard on/off switch 47, which eliminates the need to unplug the unit to turn it off. A surge protector 45 may protect electronic components, such as the timer, from power surges.

The warmer may also include a cutoff switch 39 as a safety feature. The cutoff switch prevents operation of the heating element when the warmer loses its orientation, such as by falling onto its side. A mercury switch is suitable. A light may be used to signal when the cutoff switch is operating.

As an additional safety feature, the warmer may have a ground fault current interrupter or GFCI 44. See FIG. 1. Since the warmer is generally placed in the vicinity of a sink used for tooth brushing, electrocution is a possible hazard. The GFCI operates cut off power when the device is grounded, such as by falling in water. A typical GFCI includes a test button 46 to test the GFC and a reset button 48 to reset the GFCI after testing. The GFCI preferably located in or adjacent to the plug 34, so that all power to the warmer is cut off when necessary.

The toothpaste compartment 16 is attached to the base 18 at a compartment angle. The compartment angle may be 90°, as in FIGS. 6 and 7. A right angle is preferred if the toothpaste container is a toothpaste pump, since pumps are generally designed to stand upright.

If the toothpaste container is a toothpaste tube 12, the compartment angle preferably is less than 90°. See FIGS. 1–4. A slant makes access to the toothpaste container easier. An angled compartment keeps the toothpaste tube visible and accessible even when the compartment extends beyond the cap end of the toothpaste tube, as in FIG. 2. The slanted compartment also has a neat and attractive appearance. Ideally the compartment angle ranges from about 25 degrees to about 70 degrees, most preferably about 55 degrees.

Any type of toothpaste pump may be used with the warmer. Several types are available. One type is a two-part refillable toothpaste pump which is oval in cross section. This pump has a height of about 10 cm and a width of about 8 cm. The refillable pump has a cup-like bottom section and a disposable top section which fits within the bottom section.

The bottom section is beveled on one side and generally includes holes in the bottom for the passage of air. The toothpaste is contained in the top section. Pressing on the top section places the toothpaste under pressure, so that it dispenses easily through a nozzle in the top section. Squeezing the sides of the bottom section allows the top section to be pulled out and its replacement to be fitted in.

Other toothpaste pumps may be oval or circular in cross-section. In one type of pump the toothpaste is placed under pressure when the user presses against a movable plate inside the base. The toothpaste then dispenses when a nozzle at the top is opened. In another version, the user squeezes the sides of the pump to place the toothpaste under pressure.

Figure 6:
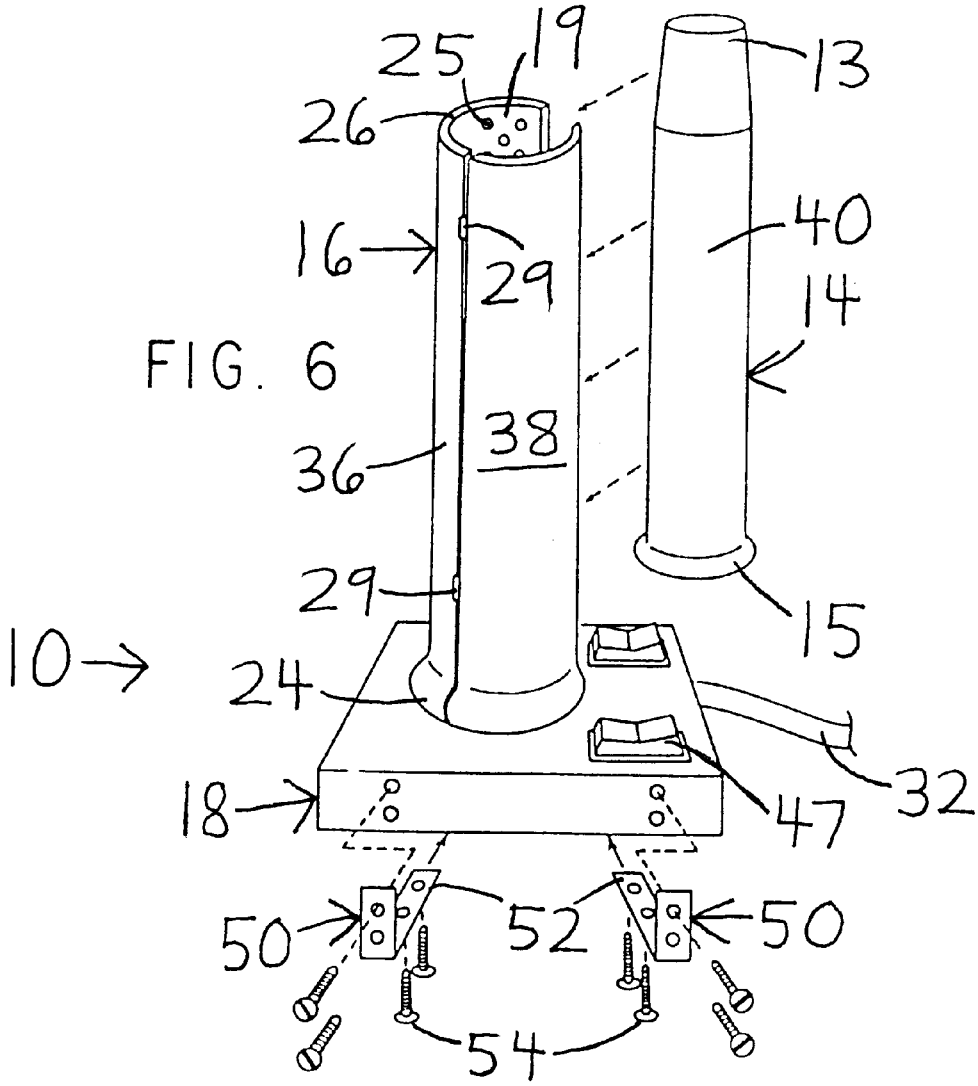
FIG. 6 is a perspective, exploded view of a toothpaste warmer for a toothpaste container having a sealed end with a bevel.

Most toothpaste pumps have in common a sealed end 15 with a bevel. An example of a beveled end is shown in FIG. 6. A beveled end allows the pump to stand upright securely on a vanity or similar surface. The bevel results in the sealed end having larger dimensions than the pump body 40. If the toothpaste compartment is wide enough for the pump to enter beveled end first, close contact between the inner shell and the pump body may not be achieved. This is particularly true if the inner shell is rigid and does not conform to the shape of the toothpaste pump. Lack of close contact leads to heat losses, particularly if the outlet end is open to the air.

To avoid this problem, the toothpaste compartment may be composed of two parts, as shown in FIG. 6: a side wall 36 and a door 38. The door 38 is pivotally attached to the side wall by hinges 29. The door 38 allows a toothpaste pump 14 to be inserted into and removed from the central cavity from the side, instead of through the outlet end. The door is dimensioned for passage of the toothpaste pump. Both the side wall 36 and the door 38 are molded at the bottom end 24 to conform to the shape of the toothpaste pump, including the bevel as necessary. See FIGS. 6 and 7. When inserted into the central cavity, the cap end 13 of the toothpaste pump protrudes above the outlet end 26 so that the pump can be easily operated.

For a two-part refillable toothpaste pump, the side wall preferably extends to about one inch below the top of the bottom section. This allows easy access to the top section for dispensing toothpaste. The holes in the bottom section allow heat to rise through the pump. The bottom section is partially exposed so that the sides of the bottom section can be manipulated to release the top section for refilling. The refill can be inserted without opening the door. The bottom section may simply be left in the toothpaste warmer permanently. Alternatively, the toothpaste compartment itself may have the proper shape to accommodate a refill top section directly.

The warmer may include two bracket assemblies 50, as shown in FIG. 6. Each bracket assembly has an L-shaped bracket 52 and is adapted to fasten the base 18 to a wall. Screws 54 attach each bracket to the wall and to the base. Suitable bracket assemblies are well known in the art.

The warmer preferably has a toothbrush compartment 56, as shown in FIG. 3. The toothbrush compartment 56 is adapted to contain a toothbrush 58. The toothbrush compartment is preferably attached to the toothpaste compartment and extends parallel or generally parallel to the toothpaste compartment. The toothbrush compartment 56 has an outlet end 60 and a bottom end 62. The heating element 20 is adapted to conduct heat to at least the bottom end 62 of the toothbrush compartment. The bottom end 62 may be in contact with the heating element, or in contact with the bottom end 24 of the toothpaste compartment. The toothbrush compartment may be constructed similarly to the toothpaste compartment, with an outer and inner shell 64 and 66.

The toothbrush 58 is less subject to degradation from heat than toothpaste, and so may be warmed to a higher temperature if desired. A temperature of up to 115° F. is acceptable for the toothbrush; higher temperatures may make the toothbrush uncomfortable to hold. Temperatures of 95–100° F. are preferred for the toothbrush temperature. If the heating element 20 is embedded in the base 18, a desirable temperature gradient may be achieved by placing the toothbrush compartment in close contact with it, and the toothpaste compartment farther away.

A single tubular member may be used to contain both the toothbrush and toothpaste compartments. A thin partition between the two sections is sufficient to keep them separated. If desired, the heating element 20 may be embedded in the tubular member to heat both compartments together.

The toothpaste warmer of the present invention has several benefits. For persons with sensitive teeth, brushing the teeth with warm toothpaste is comfortable and pleasant. Using a warm toothbrush as well enhances this effect. No time is wasted running hot water over a toothbrush. The expense of toothpaste specially formulated for sensitive teeth can be avoided. The toothpaste warmer is easy to use and easy to keep clean.

Since the warmer makes tooth brushing comfortable for persons with sensitive teeth, brushing becomes less of a chore and is done much more frequently. Even persons whose teeth are not particularly sensitive to cold find brushing with a warm toothbrush and toothpaste pleasant. Children, in particular, like to brush with warm toothpaste. Brushing is also more thorough. Better brushing improves dental hygiene and reduces dental bills.

It is to be understood that the present invention is not limited to the sole embodiments described above, but encompasses any and all embodiments within the scope of the following claims.

I claim:

1. A warmer for heating a toothpaste container, comprising:

(a) a toothpaste compartment having a central cavity, a bottom end, and an outlet end, wherein said central cavity is adapted to hold the toothpaste container;

(b) a base attached to said bottom end of said toothpaste compartment, said base being attached to said toothpaste compartment at a compartment angle ranging from about 25 degrees to about 70 degrees, wherein said base is adapted to stabilize said toothpaste compartment, and said base has a connecting means for connecting to an electrical source; and (c) a heating element attached to said base, said heating element receiving power from said connecting means, wherein said heating element is adapted to conduct heat to at least said bottom end of said toothpaste compartment.

2. The warmer according to claim 1, wherein said base has a weight at least equal to the weight of said toothpaste compartment and the toothpaste container.

3. The warmer according to claim 1, wherein said toothpaste compartment is composed of a material selected from the group consisting of metal and plastic.

4. The warmer according to claim 1, wherein said heating element is embedded in said base, and said bottom end of said toothpaste compartment contacts said heating element.

5. The warmer according to claim 1, wherein said toothpaste compartment includes a container cap pivotally attached to said outlet end of said toothpaste compartment.

6. The warmer according to claim 1, wherein the toothpaste container is a toothpaste tube.

7. The warmer according to claim 1, wherein said heating element maintains the toothpaste container at a temperature between about 80 degrees and about 90 degrees Fahrenheit.

8. The warmer according to claim 1, wherein said heating element includes a thermostat.

9. The warmer according to claim 1, wherein the warmer includes a timer, said timer controlling said heating element so that the toothpaste container is heated at preset times.

10. The warmer according to claim 1, wherein the warmer includes a cutoff switch, said cutoff switch preventing operation of said heating element when the warmer loses its orientation.

11. The warmer according to claim 1, wherein the warmer further comprises a ground fault current interrupter.

12. The warmer according to claim 1, wherein said toothpaste compartment has an outer shell and an inner shell, and said inner shell of said toothpaste compartment surrounds said central cavity.

13. The warmer according to claim 12, wherein said outer shell of said toothpaste compartment includes a layer of insulating material.

14. The warmer according to claim 12, wherein said heating element is located between said outer and said inner shells of said toothpaste compartment.

15. The warmer according to claim 12, wherein said inner shell of said toothpaste compartment conforms to the shape of the toothpaste container.

16. A warmer for heating a toothpaste container, comprising:

(a) a toothpaste compartment having a central cavity adapted to hold the toothpaste container. said toothpaste compartment having an outer shell and an inner shell and including a bottom end and an outlet end, wherein said inner shell of said toothpaste compartment surrounds said central cavity and has at least two perforations;

(b) a base attached to said bottom end of said toothpaste compartment and adapted to stabilize said toothpaste compartment, said base including connecting means for connecting to an electrical source; and (c) a heating element attached to said base, said heating element receiving power from said connecting means, wherein said heating element is adapted to conduct heat to at least said bottom end of said toothpaste compartment.

17. The warmer according to claim 10, wherein the toothpaste container is a toothpaste pump.

18. The warmer according to claim 16, wherein said toothpaste compartment includes a side wall and a door, said door being pivotally attached to said side wall, and said door being dimensioned for passage of the toothpaste container, so that the toothpaste container passes through said door for placement in and removal from said central cavity.

19. A warmer for heating a toothpaste container comprising:

(a) a toothpaste compartment having a central cavity adapted to hold the toothpaste container, said toothpaste compartment including a bottom end and an outlet end;

(b) a toothbrush compartment adapted to contain a toothbrush, said toothbrush compartment being attachable to said toothpaste compartment in a generally parallel orientation;

(c) a base attached to said bottom end of said toothpaste compartment and adapted to stabilize said toothpaste compartment, said base including connecting means for connecting to an electrical source; and (d) a heating element attached to said base, said heating element receiving power from said connecting means, wherein said heating element is adapted to conduct heat to at least said bottom end of said toothpaste compartment.

* * * * *